US011024965B2

(12) United States Patent
Komura

(10) Patent No.: US 11,024,965 B2
(45) Date of Patent: Jun. 1, 2021

(54) DUAL BAND ANTENNA DEVICE

(71) Applicant: Murata Manufacturing Co., Ltd., Kyoto (JP)

(72) Inventor: Ryo Komura, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/654,191

(22) Filed: Oct. 16, 2019

(65) Prior Publication Data

US 2020/0044342 A1 Feb. 6, 2020

Related U.S. Application Data

(63) Continuation of application No. PCT/JP2018/018891, filed on May 16, 2018.

(30) Foreign Application Priority Data

Jun. 27, 2017 (JP) ..... JP2017-124781

(51) Int. Cl.
*H01Q 5/314* (2015.01)
*H01Q 5/335* (2015.01)
(Continued)

(52) U.S. Cl.
CPC ..... *H01Q 5/335* (2015.01); *H01Q 1/50* (2013.01); *H01Q 5/10* (2015.01); *H01Q 7/00* (2013.01); *H01Q 9/40* (2013.01)

(58) Field of Classification Search
CPC ..... H01Q 5/335; H01Q 5/10; H01Q 1/50; H01Q 7/00; H01Q 9/40; H01Q 1/243
See application file for complete search history.

(56) References Cited

U.S. PATENT DOCUMENTS

2003/0076264 A1* 4/2003 Yuanzhu ..... H01Q 9/36 343/700 MS
2006/0109184 A1* 5/2006 Chen ..... H01Q 1/48 343/702
(Continued)

FOREIGN PATENT DOCUMENTS

JP 2003-133839 A 5/2003
JP 2003133839 A * 5/2003 ..... H01Q 1/36
(Continued)

OTHER PUBLICATIONS

International Search Report for PCT/JP2018/018891 dated Jul. 31, 2018.
Written Opinion for PCT/JP2018/018891 dated Jul. 31, 2018.

*Primary Examiner* — Dimary S Lopez Cruz
*Assistant Examiner* — Bamidele A Jegede
(74) *Attorney, Agent, or Firm* — Pearne & Gordon LLP

(57) ABSTRACT

The dual-band antenna device includes: a feeding electrode that branches into a first branch feeding electrode that serves as a low-frequency signal path and a second branch feeding electrode that serves as a high-frequency signal path; and a radiation electrode having a rectangular shape with a longitudinal direction and having a low-frequency feeding point to which the first branch feeding electrode is electrically connected and a high-frequency feeding point to which the second branch feeding electrode is electrically connected. In the radiation electrode, the low-frequency feeding point or the high-frequency feeding point is formed close to an end portion of the rectangular shape in the longitudinal direction, and the high-frequency feeding point or the low-frequency feeding point is formed at a center portion of a side of the rectangular shape that extends in the longitudinal direction.

20 Claims, 10 Drawing Sheets

(51) Int. Cl.

| | |
|---|---|
| ***H01Q 5/10*** | (2015.01) |
| ***H01Q 1/50*** | (2006.01) |
| ***H01Q 7/00*** | (2006.01) |
| ***H01Q 9/40*** | (2006.01) |

(56) References Cited

U.S. PATENT DOCUMENTS

2006/0176233 A1* 8/2006 Tang ..... H01Q 9/40 343/850
2008/0150807 A1* 6/2008 Lin ..... G06F 1/1698 343/702
2010/0271271 A1* 10/2010 Wu ..... H01Q 1/38 343/702
2011/0122027 A1* 5/2011 Wong ..... H01Q 9/045 343/700 MS
2011/0205138 A1* 8/2011 Yanagi ..... H01Q 9/42 343/845
2011/0221642 A1* 9/2011 Bungo ..... H01Q 5/328 343/749
2012/0092220 A1* 4/2012 Tani ..... H01Q 7/00 343/702
2013/0057443 A1* 3/2013 Asanuma ..... H01Q 9/30 343/751
2013/0135164 A1* 5/2013 Asanuma ..... H01Q 9/26 343/749
2013/0147674 A1* 6/2013 Komura ..... H01Q 9/045 343/750
2013/0229320 A1* 9/2013 Asanuma ..... H01Q 7/00 343/788
2013/0234902 A1* 9/2013 Asanuma ..... H01Q 5/321 343/749
2014/0292587 A1* 10/2014 Yarga ..... H01Q 5/378 343/702
2014/0347241 A1* 11/2014 Kim ..... H01Q 1/243 343/845
2017/0018839 A1* 1/2017 Harper ..... H01Q 1/48

FOREIGN PATENT DOCUMENTS

JP 2011-078037 A 4/2011
WO 2012/124247 A1 9/2012

* cited by examiner

DUAL BAND ANTENNA DEVICE

This is a continuation of International Application No. PCT/JP2018/018891 filed on May 16, 2018 which claims priority from Japanese Patent Application No. 2017-124781 filed on Jun. 27, 2017. The contents of these applications are incorporated herein by reference in their entireties.

BACKGROUND OF THE DISCLOSURE

Field of the Disclosure

The present disclosure relates to an antenna device used for wireless communications, and more particularly relates to a dual-band antenna device that operates at a low-frequency and a high-frequency with respect to radio-frequency signals.

Description of the Related Art

As a dual-band antenna device of the related art, for example, a configuration of a radiator in which a capacitor and an inductor are provided between two radiation conductors has been proposed (for example, refer to Patent Document 1). The antenna device in Patent Document 1 realizes dual-band operation by operating in either a loop antenna mode or a monopole antenna mode using the two radiation conductors in accordance with the operation frequency of the radiator.

FIG. 18 is a diagram illustrating the configuration of the antenna device disclosed in Patent Document 1. In the antenna device in Patent Document 1, a radiator 100 is formed of two radiation conductors 101 and 102, an inductor 103, and a capacitor 104. The first radiation conductor 101 has a square U shape and has two end portions. The inductor 103 is connected to one end of the first radiation conductor 101, and the capacitor 104 is connected to the other end of the first radiation conductor 101. Similarly, the second radiation conductor 102 has a square U shape and has two end portions. The inductor 103 is connected to one end of the second radiation conductor 102, and the capacitor 104 is connected to the other end of the second radiation conductor 102. In the antenna device disclosed in Patent Document 1, the radiator 100 is configured such that the first radiation conductor 101, the inductor 103, the second radiation conductor 102, and the capacitor 104, are connected to each other in a loop.

In the antenna device of the related art illustrated in FIG. 18, a signal source 105 of low-frequency and high-frequency radio-frequency signals is connected to a corner part of the first radiation conductor 101 at a feeding point P1 (refer to FIG. 18). Furthermore, the signal source 105 is connected to a ground conductor 106, which is provided close to the radiator 100, at a feeding point P2.

Patent Document 1: International Publication No. 2012/124247

BRIEF SUMMARY OF THE DISCLOSURE

In the antenna device of the related art illustrated in FIG. 18, when the radiator 100 is excited at a low-frequency, a current flows through the two radiation conductors 101 and 102, which are electrically connected to each other in a loop, via the inductor 103 and the capacitor 104, and the radiator 100 operates in the loop antenna mode. An open end of the current flowing through the radiation conductors 101 and 102 at this time is at a position in the second radiation conductor 102 close to the ground conductor 106. On the other hand, when the radiator 100 is excited at a high-frequency, a current flows to the second radiation conductor 102 via the capacitor 104 but hardly any current flows through the inductor 103 between the first radiation conductor 101 and the second radiation conductor 102, and the radiator 100 operates in the monopole antenna mode. The open end of the current flowing through the second radiation conductor 102 at this time is also at a position in the second radiation conductor 102.

There is a problem with the configuration of the antenna device illustrated in FIG. 18 in that the antenna efficiency in the low-frequency band and the antenna efficiency in the high-frequency band are affected by each other and when the antenna efficiency is optimized in either the low-frequency band or the high-frequency band, the antenna efficiency in the other frequency band deteriorates.

An object of the present disclosure is to provide a dual-band antenna device that has high antenna performance in both low-frequency and high-frequency resonance operations.

In order to achieve this object, one aspect of the present disclosure provides a dual-band antenna device that includes: a power source that outputs low-frequency and high-frequency signals; a feeding electrode to which the low-frequency and high-frequency signals are supplied from the power source and that branches into a first branch feeding electrode that mainly serves as a low-frequency signal path and a second branch feeding electrode that mainly serves as a high-frequency signal path; a radiation electrode having a rectangular shape with a longitudinal direction and having a low-frequency feeding point to which the first branch feeding electrode is electrically connected and a high-frequency feeding point to which the second branch feeding electrode is electrically connected; an inductor element that is provided in the feeding electrode and forms the low-frequency signal path in the feeding electrode; and a capacitor element that is provided in the feeding electrode and forms the high-frequency signal path in the feeding electrode. In the radiation electrode, the low-frequency feeding point is formed close to an end portion of the rectangular shape in the longitudinal direction and the high-frequency feeding point is formed at a center portion of a side of the rectangular shape that extends in the longitudinal direction, or the high-frequency feeding point is formed close to an end portion of the rectangular shape in the longitudinal direction, and the low-frequency feeding point is formed at a center portion of a side of the rectangular shape that extends in the longitudinal direction.

According to the present disclosure, there can be provided a dual-band antenna device that has high antenna performance in both low-frequency and high-frequency resonance operations.

DETAILED DESCRIPTION OF THE DISCLOSURE

Figure 1:
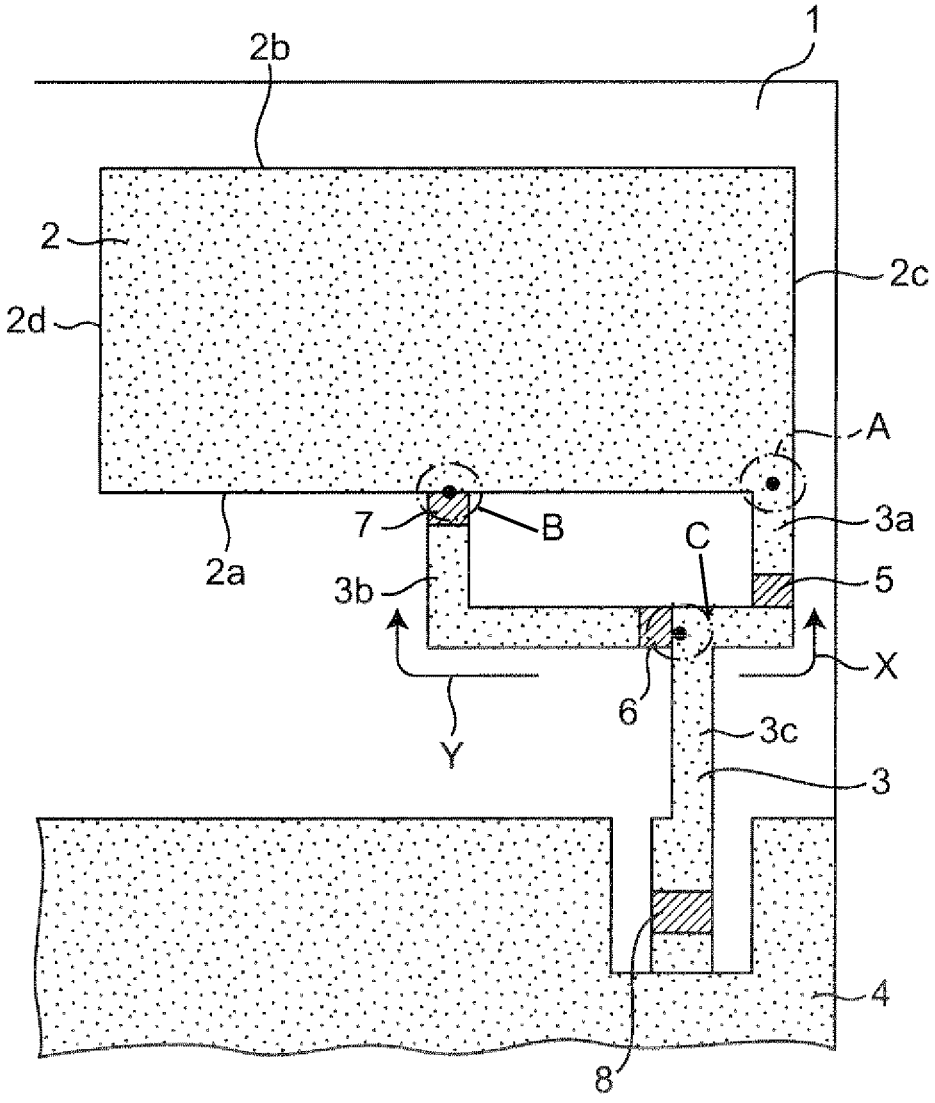
FIG. 1 is a diagram illustrating the configuration of a dual-band antenna device of embodiment 1 according to the present disclosure.

First, the configurations dual-band antenna devices according to various aspects of the present disclosure will be described.

A dual-band antenna device of a first aspect of the present disclosure includes:

a power source that outputs low-frequency and high-frequency signals;

a feeding electrode to which the low-frequency and high-frequency signals are supplied from the power source and that branches into a first branch feeding electrode that mainly serves as a low-frequency signal path and a second branch feeding electrode that mainly serves as a high-frequency signal path;

a radiation electrode having a rectangular shape with a longitudinal direction and having a low-frequency feeding point to which the first branch feeding electrode is electrically connected and a high-frequency feeding point to which the second branch feeding electrode is electrically connected;

an inductor element that is provided in the feeding electrode and forms the low-frequency signal path in the feeding electrode; and a capacitor element that is provided in the feeding electrode and forms the high-frequency signal path in the feeding electrode.

In the radiation electrode, the low-frequency feeding point is formed close to an end portion of the rectangular shape in the longitudinal direction and the high-frequency feeding point is formed at a center portion of a side of the rectangular shape that extends in the longitudinal direction, or the high-frequency feeding point is formed close to an end portion of the rectangular shape in the longitudinal direction, and the low-frequency feeding point is formed at a center portion of a side of the rectangular shape that extends in the longitudinal direction.

In the thus-configured dual-band antenna device of the first aspect, the antenna efficiency can be optimized at the respective resonant frequencies in both the low-frequency band and the high-frequency band without the antenna efficiency in the low-frequency band and the antenna efficiency in the high-frequency band affecting each other.

A dual-band antenna device of a second aspect of the present disclosure may be configured so that, in the radiation electrode of the first aspect, the low-frequency feeding point is formed close to an end portion of a side of the rectangular shape that extends in the longitudinal direction and a low-frequency signal is supplied thereto from the power source, and the high-frequency feeding point is formed at a center portion of a side of the rectangular shape that extends in the longitudinal direction and a high-frequency signal is supplied thereto from the power source.

A dual-band antenna device of a third aspect of the present disclosure may be configured so that, in the radiation electrode of the first aspect, the low-frequency feeding point is formed on a side of the rectangular shape that extends in a direction perpendicular to the longitudinal direction and a low-frequency signal is supplied thereto from the power source, and the high-frequency feeding point is formed at a center portion of a side of the rectangular shape that extends in the longitudinal direction, and a high-frequency signal is supplied thereto from the power source.

In a dual-band antenna device of a fourth aspect of the present disclosure, the inductor element may be provided on a path extending from the power source to the low-frequency feeding point of the radiation electrode via the first branch feeding electrode in any one of the first to third aspects.

In a dual-band antenna device of a fifth aspect of the present disclosure, the capacitor element may be provided on a path extending from the power source to the high-frequency feeding point of the radiation electrode via the second branch feeding electrode in any one of the first to fourth aspects.

In a dual-band antenna device of a sixth aspect of the present disclosure, at least two capacitor elements may be provided on the path extending from the power source to the high-frequency feeding point of the radiation electrode via the second branch feeding electrode in the fifth aspect.

In a dual-band antenna device of a seventh aspect of the present disclosure, the dual-band antenna device may further include a ground electrode to which the power source is connected, and as well as having a rectangular shape with a longitudinal direction, the radiation electrode may be formed to have a convex shape that projects toward the ground electrode, the high-frequency feeding point may be arranged at a center portion of the convex shape and the second branch feeding electrode may be electrically connected thereto, and when excitation is performed using a high-frequency signal, a long side of the rectangular shape that extends in the longitudinal direction and faces the convex shape may act as an open end in any one of the first to sixth aspects.

In a dual-band antenna device of an eighth aspect of the present disclosure, the feeding electrode may include a common feeding electrode to which low-frequency and high-frequency signals are supplied from the power source and that branches into the first branch feeding electrode and the second branch feeding electrode, and the inductor element may be electrically connected to the first branch feeding electrode, and the capacitor element may be electrically connected to the second branch feeding electrode in any one of the first to seventh aspects.

In a dual-band antenna device of a ninth aspect of the present disclosure, the inductor element may be formed of a conductor pattern having an inductance in any one of the first to eighth aspects.

In a dual-band antenna device of a tenth aspect of the present disclosure, the capacitor element may be formed of a conductor pattern having a capacitance in any one of the first to ninth aspects.

Hereafter, a dual-band antenna device according to the present disclosure will be described while referring to the drawings using a plurality of embodiments illustrating various configurations. The configurations of antenna devices that operate with frequencies of a 2.4 GHz band and a 5 GHz band frequency as low and high resonance frequencies will be described as dual-band antenna devices in the following description, but the present disclosure is limited to these frequency bands.

Embodiment 1

FIG. 1 is a diagram illustrating the configuration of a dual-band antenna device according to embodiment 1 of the present disclosure. As illustrated in FIG. 1, in the dual-band antenna device of embodiment 1, electrode patterns (2, 3, and 4) are formed and various adjusting elements (5, 6, and 7) are provided on a base 1 formed of a dielectric material or the like.

In the dual-band antenna device of embodiment 1, a rectangular radiation electrode 2, a feeding electrode 3 that branches into two branches, and a ground electrode 4 that is grounded are formed on the same plane. The radiation electrode 2 has a substantially rectangular shape, and a first branch feeding electrode 3*a* and a second branch feeding electrode 3*b* of the feeding electrode 3 are electrically connected to one side (lower long side in FIG. 1) 2*a* of the radiation electrode 2 that extends in the longitudinal direction of the radiation electrode 2. The radiation electrode 2 is provided at a position that is separated from the ground electrode 4 by a prescribed distance (for example, several millimeters). In the radiation electrode 2, the long side 2*a* to which the feeding electrode 3 is electrically connected is the long side that faces and is closest to the ground electrode 4. In addition, in this specification, "electrically connected" refers to not only the case of being connected in direct contact but also the case of being connected via an electrical element such as a capacitor element or an inductor element.

The feeding electrode 3 includes the first branch feeding electrode 3*a* and the second branch feeding electrode 3*b*, which are electrically connected to the long side 2*a* of the radiation electrode 2 that faces the ground electrode 4, and a common feeding electrode 3*c*. One end of the common feeding electrode 3*c* is connected to a power source 8 and the other end of the common feeding electrode 3*c* is continuously connected to and branched into the first branch feeding electrode 3*a* and the second branch feeding electrode 3*b*. In FIG. 1, the connection point between the first branch feeding electrode 3*a* and the radiation electrode 2 is indicated by a symbol "A", and the connection point between the second branch feeding electrode 3*b* and the radiation electrode 2 is indicated by a symbol "B". Furthermore, a branching point at which the feeding electrode 3 branches into the two branches is indicated by a symbol "C".

The position of the connection point A is close to one end portion of the long side 2*a* of the radiation electrode 2. "Close to an end portion" in this specification and so forth refers to a position that is within 20% of the length of the long side 2*a* of the radiation electrode 2 from the end portion of the radiation electrode 2 in the longitudinal direction. On other hand, the position of the connection point B is a position at a center portion of the long side 2*a* of the radiation electrode 2. The position of the connection point A serves as a low-frequency feeding point to which the low-frequency signal is supplied. On the other hand, the position of the connection point B serves as a high-frequency feeding point to which the high-frequency signal is supplied. "Center portion" in the present specification and so forth refers to a position within ±10% of the length of a certain side of the radiation electrode 2 from the center of the side.

The common feeding electrode 3*c* and the first branch feeding electrode 3*a* are electrically connected to each other via the first adjusting element 5. An inductor element (inductor chip) having an inductance is used as the first adjusting element 5. On the other hand, the second adjusting element 6 is provided between the common feeding electrode 3*c* and the second branch feeding electrode 3*b*, and the common feeding electrode 3*c* and the second branch feeding electrode 3*b* are electrically connected to each other via the second adjusting element 6. Furthermore, the second branch feeding electrode 3*b* is connected to the radiation electrode 2 via the third adjusting element 7. Capacitor elements (capacitor chips) having capacitances are used as the second adjusting element 6 and the third adjusting element 7.

The second adjusting element 6 is provided at the branching point C. In addition, the third adjusting element 7 is connected to the connection point B. Although the first adjusting element 5 is provided at the connection point between the common feeding electrode 3*c* and the first branch feeding electrode 3*a*, the first adjusting element 5 is spaced apart from the position of the branching point C, and the first adjusting element 5 and the second adjusting element 6 are connected to each other via the common feeding electrode 3*c*.

As described above, the first adjusting element 5 is provided on a first current path X (low-frequency feeding path) that extends from the power source 8 to the radiation electrode 2 via the common feeding electrode 3*c* and the first branch feeding electrode 3*a*. On the other hand, the second adjusting element 6 and the third adjusting element 7 are provided on a second current path Y (high-frequency feeding path) that extends from the power source 8 to the radiation electrode 2 via the common feeding electrode 3*c* and the second branch feeding electrode 3*b*.

In the configuration of embodiment 1, the second adjusting element 6 and the third adjusting element 7 are connected in series with each other on the second current path Y (high-frequency feeding path). Therefore, the dual-band antenna device of embodiment 1 has a configuration that allows fine adjustment in a resonance operation.

As described above, one end of the power source 8 is electrically connected to the feeding electrode 3 so as to supply low-frequency and high-frequency signals to the feeding electrode 3 and excite the radiation electrode 2, and the other end of the power source 8 is electrically connected to the ground electrode 4.

[Excitation Operation in Dual-Band Antenna Device]

First, description will be given of an excitation operation of exciting the radiation electrode 2 in the dual-band antenna device of embodiment 1 that is induced by the power source 8 supplying a signal having a low-frequency, for example, the frequency of a 2.4 GHz band, to the feeding electrode 3. In this excitation operation, a current from the power source 8 is supplied to a connection point (low-frequency feeding point A) of the radiation electrode 2 via the branch point C, along the first branch feeding electrode 3*a* and through the first adjusting element 5, which is a low impedance inductor element, for example. In other words, when a low-frequency signal is supplied to the feeding electrode 3, the low-frequency signal is supplied along the first current path X (low-frequency feeding path) to the low-frequency feeding point A of the radiation electrode 2. When a low-frequency signal is supplied to the feeding electrode 3, since the second adjusting element 6, which is a capacitor having a high impedance, is provided at the branching point C, the current from the power source 8 negligibly flows along the second current path Y (high-frequency feeding path) and mainly flows along the first current path X (low-frequency feeding path) and is supplied to the low-frequency feeding point A of the radiation electrode 2.

When a current is supplied to the low-frequency feeding point A, which is at the position of an end portion of the radiation electrode 2 in the longitudinal direction, the current flows along the longitudinal direction from the one end portion of the radiation electrode 2 to the other end portion of the radiation electrode 2 on the opposite side, and low-frequency radio waves are radiated from the radiation electrode 2. As a result, in the dual-band antenna device of embodiment 1, a monopole antenna is formed in which one short-side end portion of the radiation electrode 2 in the longitudinal direction serves as a feeding end, and the other short-side end portion of the radiation electrode 2 in the longitudinal direction acts as an open end.

Next, description will be given of an excitation operation of exciting the radiation electrode 2 in the antenna device that is induced by the power source 8 supplying a signal having a high-frequency, for example, the frequency of a 5 GHz band, to the feeding electrode 3. In this excitation operation, a current from the power source 8 is supplied to a connection point (high-frequency feeding point B) of the radiation electrode 2 via the branching point C and through the second adjusting element 6, which is a capacitor element having a low impedance, the second branch feeding electrode 3*b* and the third adjusting element 7. In other words, when a high-frequency signal is supplied to the feeding electrode 3, the high-frequency signal is supplied along the second current path Y (high-frequency feeding path) to the high-frequency feeding point B of the radiation electrode 2. At this time, since the first adjusting element 5, which is an inductor element having a high impedance, is provided close to the branching point C, the current from the power source 8 negligibly flows along the first current path X (low-frequency feeding path) and mainly flows along the second current path Y (high-frequency feeding path) and is supplied to the high-frequency feeding point B of the radiation electrode 2.

When the current is supplied to the high-frequency feeding point B, which is at the position of a center portion of the long side 2*a* of the radiation electrode 2 that extends in the longitudinal direction, the current flows in a lateral direction (upward in FIG. 1) from the one long side (2*a*) of the radiation electrode 2. In this way, the current in the radiation electrode 2 flows toward the other long side (2*b*), which is on the opposite side, and high-frequency radio waves are radiated without return loss from the radiation electrode 2. As a result, in the dual-band antenna device of embodiment 1, a monopole antenna is formed in which one long side (2*a*) end portion of the radiation electrode 2 in the longitudinal direction serves as a feeding region and the other long side (2*b*) end portion of the radiation electrode 2 in the longitudinal direction acts as an open end.

Figure 2:
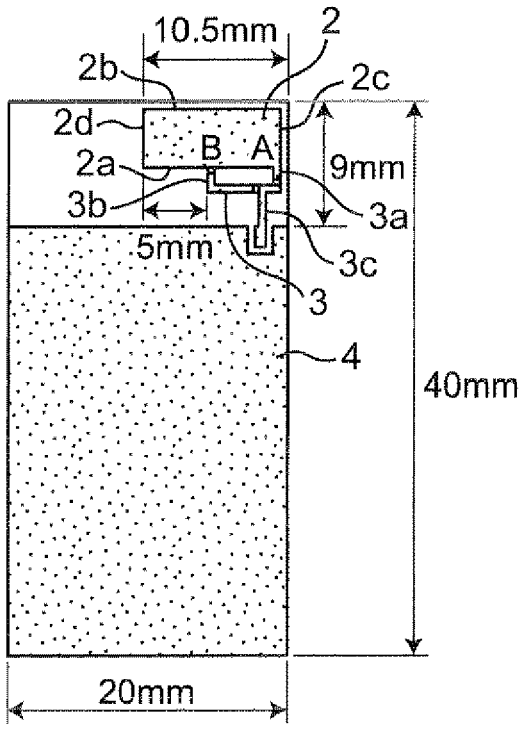
FIG. 2 is a diagram illustrating a specific example configuration used in a simulation experiment for the dual-band antenna device of embodiment 1.

FIG. 2 is a diagram illustrating a specific example configuration used in a simulation experiment for the dual-band antenna device of embodiment 1. As illustrated in FIG. 2, the radiation electrode 2 has a length of 10.5 mm in the longitudinal direction and a length of 4.5 mm in the lateral direction. The position of the high-frequency feeding point B in the radiation electrode 2 at which the second branch feeding electrode 3*b* is electrically connected to the radiation electrode 2 is a position that is at a center portion of the long side 2*a* of the radiation electrode 2 and is 5.0 mm from the end portion (left end in FIG. 2) of the radiation electrode 2 in the longitudinal direction. The distance from the long side 2*b* of the radiation electrode 2 where the second branch feeding electrode 3*b* is not connected to the proximal side of the ground electrode 4 is 9.0 mm and the distance to the far side of the ground electrode 4 is 40.0 mm. In addition, the ground electrode 4 has a rectangular shape with a length and width of 31.0 mm×20.0 mm.

Furthermore, the frequency bands used in the simulation experiment are a 2.4 GHz band (2.4-2.484 GHz) and a 5 GHz band (5.15-5.85 GHz) of a WLAN, which is a wireless LAN. A 2.4 nH inductor chip is used as the first adjusting element 5, which is an inductor element. 0.4 pF capacitor chips are used as the second adjusting element 6 and the third adjusting element 7, which are capacitor elements.

Figure 3:
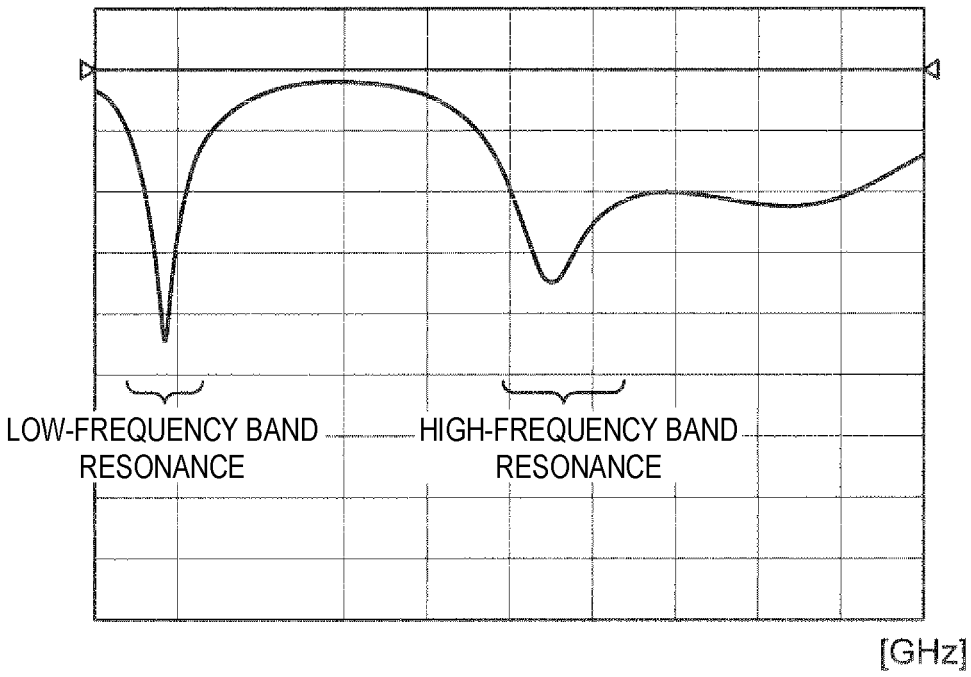
FIG. 3 is a frequency characteristic diagram illustrating the results of the simulation experiment for the dual-band antenna device of embodiment 1.

FIG. 3 is a frequency characteristic diagram illustrating the results of the simulation experiment performed for the dual-band antenna device of embodiment 1 configured as described above. In the frequency characteristic diagram of FIG. 3, the vertical axis represents return loss and the horizontal axis represents frequency. As illustrated in the frequency characteristic diagram of FIG. 3, it is clear that radiation is performed with very small return loss and high efficiency in resonance operations in two frequency bands at a low-frequency (2.4 GHz band) and a high-frequency (5 GHz band).

Figure 4A:
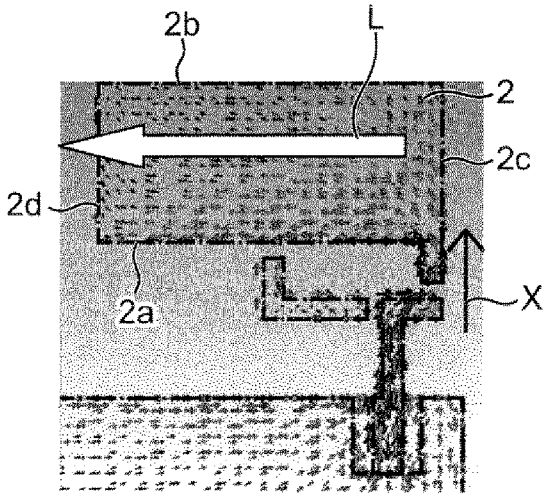
FIGS. 4A and 4B illustrate diagrams depicting results obtained from the simulation experiment using low-frequency and high-frequency signals for the dual-band antenna device of embodiment 1.
Figure 4B:
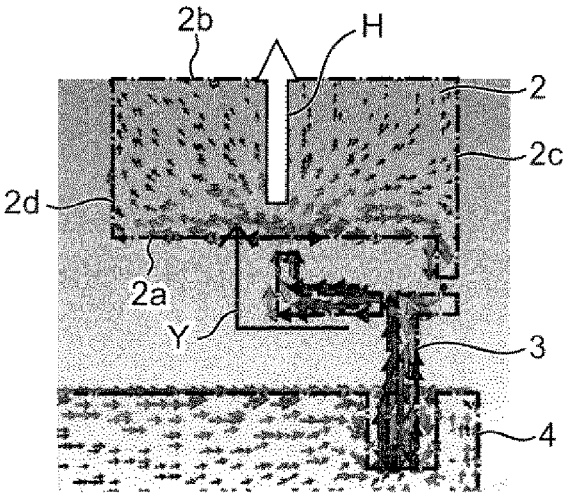

FIG. 4A is a diagram illustrating the results obtained in a simulation experiment regarding the manner in which the current flows when excitation is performed using a low-frequency (2.4 GHz band) signal in the dual-band antenna device of embodiment 1. In addition, FIG. 4B is a diagram illustrating the results obtained in a simulation experiment regarding the manner in which the current flows when excitation is performed using a high-frequency (5 GHz band) signal. In FIGS. 4A and 4B, the results in which the magnitude of a current flowing in the electrode pattern is represented by a color arrow are illustrated in black and white achromatic colors and therefore it is not easy to determine the magnitude of the current. However, it is clear from the experimental results obtained by the inventors that the path along which the low-frequency signal (2.4 GHz band) flows (first current path X: refer to FIG. 4A) and the path along which the high-frequency signal (5 GHz band) flows (second current path Y: refer to FIG. 4B) are different from each other.

In other words, when excitation is performed using a low-frequency (2.4 GHz band) signal, the current from the power source 8 negligibly flows along the second current path Y (high-frequency feeding path) and mainly flows along the first current path X (low-frequency feeding path) and is supplied to the low-frequency feeding point A of the radiation electrode 2. On the other hand, when excitation is performed using a high-frequency (5 GHz band) signal, the current from the power source 8 negligibly flows along the first current path X (low-frequency feeding path) and mainly flows along the second current path Y (high-frequency feeding path) and is supplied to the high-frequency feeding point B of the radiation electrode 2.

In addition, when excitation is performed using a low-frequency (2.4 GHz band) signal, a current flows from one short side (2*c*) region of the radiation electrode 2 to another short side (2*d*) region of the radiation electrode 2 (refer to arrow L in FIG. 4A). Then, the current dissipates in the other short side (2*d*) region of the radiation electrode 2 and the other short side 2*d* acts as the open end side. On the other hand, when excitation is performed using a high-frequency (5 GHz) signal, a current flows from the center portion of one long side 2*a* of the radiation electrode 2 to another long side (2*b*) region of the radiation electrode 2 (refer to arrow H in FIG. 4B). Then, the current dissipates in the other long side (2*b*) region and the other long side 2*b* acts as the open end side.

As described above, in the dual-band antenna device of embodiment 1, with the rectangular radiation electrode 2 having a single configuration, the antenna efficiency can be optimized at the respective resonant frequencies in both the low-frequency band and the high-frequency band without the antenna efficiency in the low-frequency band and the antenna efficiency in the high-frequency band affecting each other. In addition, in the configuration of embodiment 1, two capacitor elements (second adjusting element 6 and third adjusting element 7) are connected in series with each other along the high-frequency feeding path Y, and therefore fine adjustment can be performed in a high-frequency resonance operation. The dual-band antenna device of embodiment 1 is a dual-band antenna device having excellent antenna performance. The dual-band antenna device has high antenna efficiency in both low-frequency and high-frequency resonance operations, and can realize band widening.

Comparative Example

Figure 5:
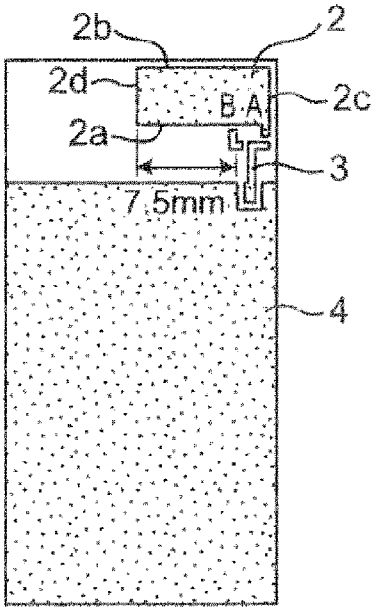
FIG. 5 is a configuration diagram illustrating a comparative example for comparison with the configuration of the dual-band antenna device of embodiment 1.

FIG. 5 is a configuration diagram illustrating a comparative example for comparison with the dual-band antenna device of embodiment 1. The inventors performed a simulation experiment for the configuration of the comparative example. In the configuration of the comparative example, the position of the high-frequency feeding point B at which the second branch feeding electrode 3*b* is electrically connected to the radiation electrode 2 is a position that is 7.5 mm from the end portion (left end in FIG. 5) of the radiation electrode 2 in the longitudinal direction and is not located at a center portion of the long side 2*a* of the radiation electrode 2. In other words, in the configuration of the comparative example, the high-frequency feeding point B is provided at a position that is shifted to one side so as to be more than about 20% from the center of the long side 2*a* of the radiation electrode 2. In the comparative example, the configurations of the other electrode patterns (2, 3*a*, 3*c*, and 4) except for the second branch feeding electrode 3*b* are identical. A 2.4 nH inductor chip is used as the first adjusting element 5, which is an inductor element, and 0.6 pF capacitor chips are used as the second adjusting element 6 and the third adjusting element 7, which are capacitor elements.

Figure 6A:
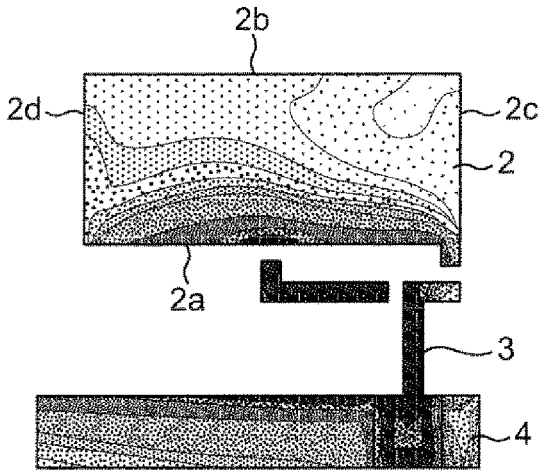
FIGS. 6A and 6B illustrate contour diagrams depicting current density when excitation is performed at a high-frequency in the dual-band antenna device of first embodiment 1 and the comparative example.
Figure 6B:
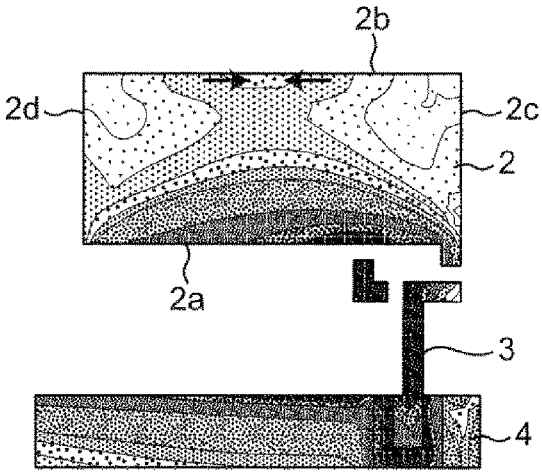

FIGS. 6A and 6B illustrate contour diagrams depicting the current density when excitation is performed at a high-frequency (5 GHz band) in the configuration of the dual-band antenna device of embodiment 1 (FIG. 6A) and the configuration of the comparative example (FIG. 6B). As illustrated in FIG. 6A, in the configuration of the dual-band antenna device of embodiment 1, the high-frequency feeding point B is provided at a center portion of the long side 2*a* of the radiation electrode 2, and as a result the current flows from the center portion of the one long side 2*a* toward the other long side 2*b* and there is a current node (open end) on the long side 2*b*. In other words, it can be confirmed that the other long side 2*b* of the radiation electrode 2 is the open end side in the configuration of the dual-band antenna device of embodiment 1.

On the other hand, in the configuration of the comparative example illustrated in FIG. 6B, the high-frequency feeding point B is provided at a position that is shifted by 20% from the center of the long side 2*a* of the radiation electrode 2. Therefore, the current flows toward the other long side 2*b* from a position that is shifted along the one long side 2*a*. As a result, the current nodes are separated on both sides of the other long side 2*b* region of the radiation electrode 2. Therefore, in the configuration of the comparative example, in the other long side 2*b* region of the radiation electrode 2, currents flow in opposite directions to each other (see arrows in FIG. 6B) and cancel each other and the antenna performance is degraded.

Figure 7:
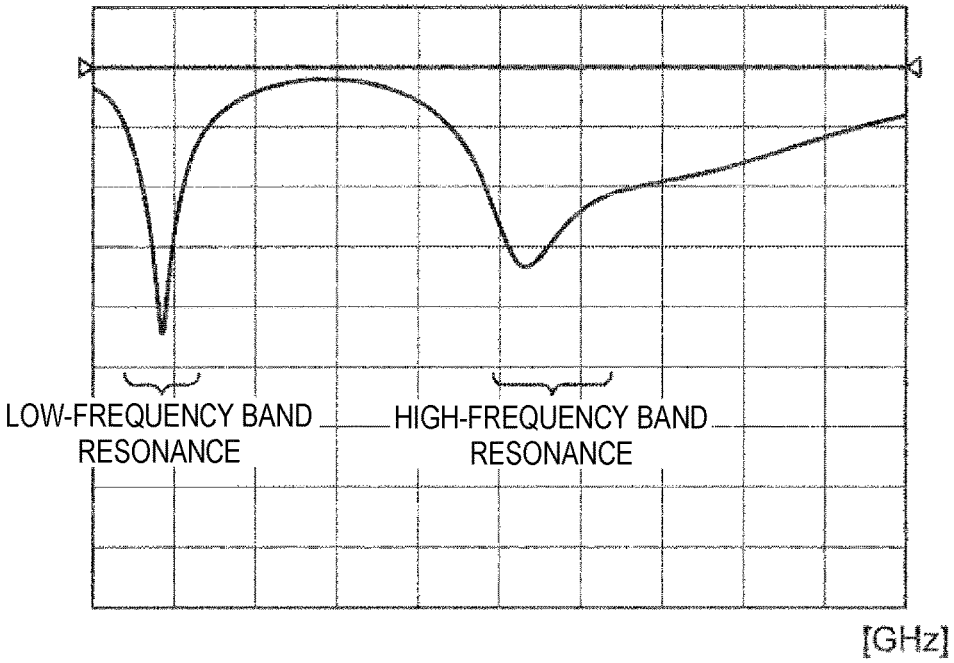
FIG. 7 is a frequency characteristic diagram illustrating the results of a simulation experiment performed for the comparative example.

FIG. 7 is a frequency characteristic diagram illustrating the results of a simulation experiment carried out for the comparative example configured as described above. In the frequency characteristic diagram of FIG. 7, the vertical axis represents return loss and the horizontal axis represents frequency. Return loss is larger and efficiency degradation can be confirmed particularly at a high-frequency (5 GHz band) compared with the frequency characteristic diagram for the dual-band antenna device of embodiment 1 illustrated in FIG. 3 as described above.

In the experiment performed by the inventors, in the case of excitation with a frequency in the high-frequency band, a desired high antenna efficiency is exhibited by providing the position of the high-frequency feeding point B at a center portion of the long side 2*a* of the radiation electrode 2.

Figure 8:
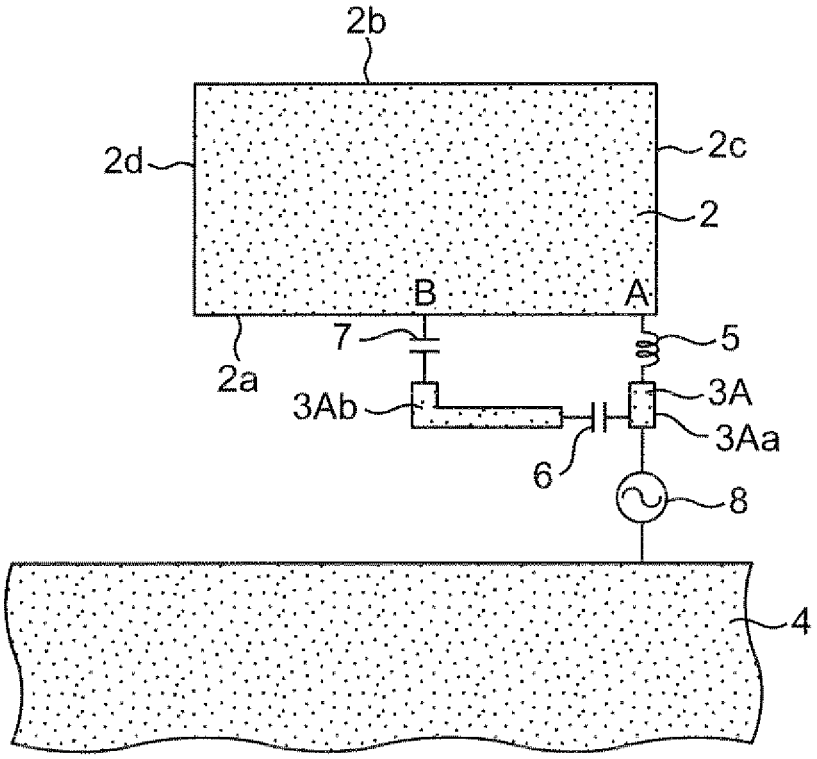
FIG. 8 is a diagram illustrating a modification of the dual-band antenna device of embodiment 1.

FIG. 8 is a diagram illustrating a modification of the dual-band antenna device of embodiment 1. The dual-band antenna device illustrated in FIG. 8 has substantially the same configuration as the dual-band antenna device illustrated in FIG. 1 except that a feeding electrode 3A is formed of a first branch feeding electrode 3Aa and a second branch feeding electrode 3Ab. In the configuration of the dual-band antenna device illustrated in FIG. 8, the power source 8 is connected to one end of the first branch feeding electrode 3Aa, and the other end of the first branch feeding electrode 3Aa is connected to the low-frequency feeding point A of the radiation electrode 2 via the first adjusting element 5, which is an inductor element. The low-frequency feeding point A of the radiation electrode 2 is at a position of an end portion of the long side 2*a* of the radiation electrode 2 similarly to as in the configuration illustrated in FIG. 1.

On the other hand, one end of the second branch feeding electrode 3Ab of the feeding electrode 3 is connected to the first branch feeding electrode 3Aa via the second adjusting element 6, which is a capacitor element, and the other end of the second branch feeding electrode 3Ab is connected to the high-frequency feeding point B of the radiation electrode 2 via the third adjusting element 7, which is another capacitor element. The high-frequency feeding point B of the radiation electrode 2 is at a position at the center portion of the long side 2*a* of the radiation electrode 2 similarly to as in the configuration illustrated in FIG. 1. In this modification as well, the position of the high-frequency feeding point B is preferably provided at the center portion of the long side 2*a* of the radiation electrode 2.

As described above, in the dual-band antenna device of embodiment 1, the antenna efficiency can be optimized at the respective resonant frequencies in both the low-frequency band and the high-frequency band without the antenna efficiency in the low-frequency band and the antenna efficiency in the high-frequency band affecting each other. In particular, the desired antenna efficiency is achieved by providing the position of the high-frequency feeding point B, which is the connection point between the radiation electrode 2 and the feeding electrode 3 for the high-frequency band, at the center portion of the long side 2*a* of the radiation electrode 2. Therefore, the dual-band antenna device of the embodiment 1 has excellent antenna performance in both a low-frequency band and a high-frequency band.

Embodiment 2

Hereafter, the configuration of a dual-band antenna device according to embodiment 2 of the present disclosure will be described while focusing on points that are different from the dual-band antenna device of embodiment 1. In the description of embodiment 2, elements having the same operations, configurations, and functions as those of embodiment 1 described above are denoted by the same reference symbols, and description thereof may be omitted in order to avoid redundant description.

The dual-band antenna device of embodiment 2 differs from the dual-band antenna device of embodiment 1 with respect to the configuration of the feeding electrode and particularly with respect to the configurations of the second branch feeding electrode and the adjusting elements.

Figure 9:
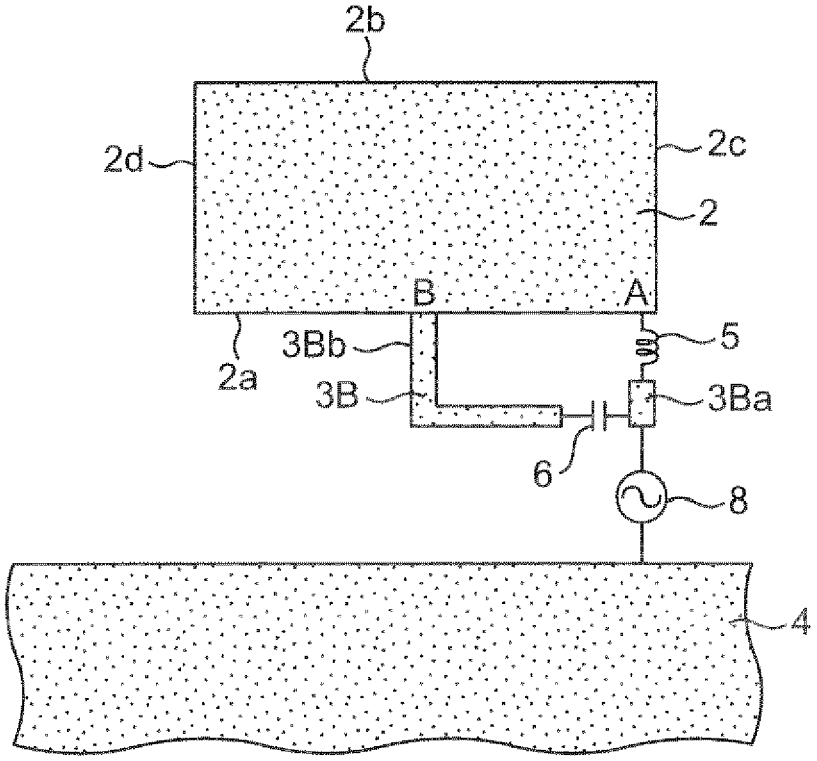
FIG. 9 is a diagram schematically illustrating the configuration of a dual-band antenna device of embodiment 2 according to the present disclosure.

FIG. 9 is a diagram schematically illustrating the configuration of the dual-band antenna device of embodiment 2. As illustrated in FIG. 9, in the configuration of the dual-band antenna device of embodiment 2, similarly to as in the configuration of embodiment 1, conductor electrode patterns consisting of the rectangular radiation electrode 2, a feeding electrode 3B that branches into two branches, and the ground electrode 4 that is grounded are formed on the same plane. In the configuration of embodiment 2, a second branch feeding electrode 3Bb of the feeding electrode 3B, which is electrically connected to a center portion (high-frequency feeding point B) of the long side 2*a* of the radiation electrode 2, is electrically connected to the first branch feeding electrode 3*a* via only the second adjusting element 6, which is a capacitor element. The dual-band antenna device of embodiment 2 differs from the above-described modification of embodiment 1 illustrated in FIG. 8 in that only one capacitor element is connected to the feeding electrode 3B.

In the configuration of embodiment 2, the feeding electrode 3B is electrically connected between the power source 8 and the low-frequency feeding point A of the radiation electrode 2 via the first adjusting element 5, which is an inductor element, and is electrically connected between the power source 8 and the high-frequency feeding point B of the radiation electrode 2 via the second adjusting element 6, which is a capacitor element.

In the thus-configured dual-band antenna device of embodiment 2, the antenna efficiency can be optimized at the respective resonant frequencies in both the low-frequency band and the high-frequency band without the antenna efficiency in the low-frequency band and the antenna efficiency in the high-frequency band affecting each other by using the radiation electrode 2 having a single configuration and the branching feeding electrode 3B. Therefore, the dual-band antenna device of embodiment 2 is a dual-band antenna device that has excellent antenna performance and can realize band widening.

Embodiment 3

Hereafter, the configuration of a dual-band antenna device according to embodiment 3 of the present disclosure will be described while focusing on the points that are different from the configurations of embodiment 1 and embodiment 2. In the description of embodiment 3, elements having the same operations, configurations, and functions as those of embodiment 1 described above are denoted by the same reference symbols, and description thereof may be omitted in order to avoid redundant description.

The dual-band antenna device of embodiment 3 differs from the dual-band antenna device of embodiment 1 with respect to the configuration of the feeding electrode.

Figure 10:
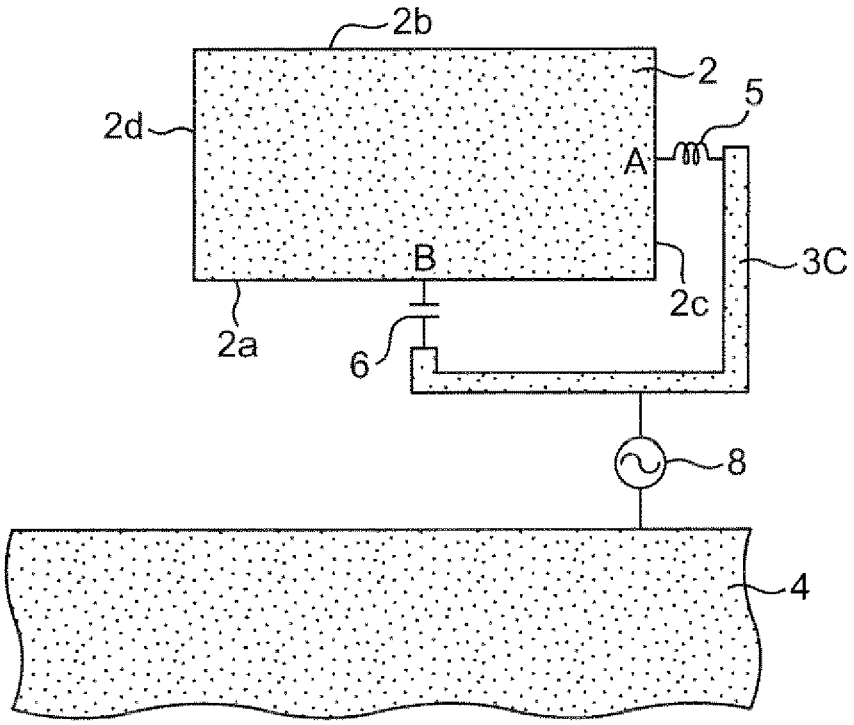
FIG. 10 is a diagram schematically illustrating the configuration of a dual-band antenna device of embodiment 3 according to the present disclosure.

FIG. 10 is a diagram schematically illustrating the configuration of the dual-band antenna device of embodiment 3. As illustrated in FIG. 10, in the configuration of the dual-band antenna device of embodiment 3, similarly to as in the configuration of embodiment 1, conductor electrode patterns consisting of the rectangular radiation electrode 2, a feeding electrode 3C, and the ground electrode 4 that is grounded are formed on the same plane.

In the configuration of embodiment 3, the feeding electrode 3C, which electrically connects the radiation electrode 2 and the power source 8 to each other, is formed of a bent line-shaped electrode pattern. One end of the feeding electrode 3C is electrically connected to the low-frequency feeding point A of the radiation electrode 2 via the first adjusting element 5, which is an inductor element. In embodiment 3, the position of the low-frequency feeding point A of the radiation electrode 2 is at a center portion of a short side 2*c* of the radiation electrode 2, which is a side that is perpendicular to the longitudinal direction of the radiation electrode 2. In other words, the low-frequency feeding point A is formed close to an end portion of the rectangular radiation electrode 2 in the longitudinal direction. On the other hand, the other end of the feeding electrode 3C is electrically connected to the high-frequency feeding point B of the radiation electrode 2 via the second adjusting element 6, which is a capacitor element. In embodiment 3, similarly to as in the configuration of embodiment 1, the position of the high-frequency feeding point B of the radiation electrode 2 is at the center portion of the long side 2*a* of the radiation electrode 2 that extends in the longitudinal direction.

In the configuration of the dual-band antenna device of embodiment 3, when excitation is performed using a low-frequency (for example, 2.4 GHz band) signal, a current flows from the short side 2*c* of the radiation electrode 2 toward another facing short side 2*d* of the radiation electrode 2 and the facing short side 2*d* acts as an open end. On the other hand, when excitation is performed using a high-frequency (for example, 5 GHz band) signal, the current flows from the center portion (high-frequency feeding point B) of the long side 2*a* of the radiation electrode 2 toward the facing long side 2*b*, and the facing long side 2*b* acts as an open end.

In the thus-configured dual-band antenna device of embodiment 3, the antenna efficiency can be optimized at the respective resonant frequencies in both a low-frequency band and a high-frequency band without the antenna efficiency in the low-frequency band and the antenna efficiency in the high-frequency band affecting each other by using the radiation electrode 2 having a single configuration and the feeding electrode 3C. Therefore, the dual-band antenna device of embodiment 3 is a dual-band antenna device that has excellent antenna performance and can realize band widening.

Embodiment 4

Hereafter, the configuration of a dual-band antenna device according to embodiment 4 of the present disclosure will be described while focusing on the points that are different from the configurations of embodiments 1 to 3. In the description of embodiment 4, elements having the same operations, configurations, and functions as those of embodiment 1 described above are denoted by the same reference symbols, and description thereof may be omitted in order to avoid redundant description.

The dual-band antenna device of embodiment 4 differs from the dual-band antenna device of embodiment 1 in that a part of an adjusting element is formed of a conductor pattern.

Figure 11:
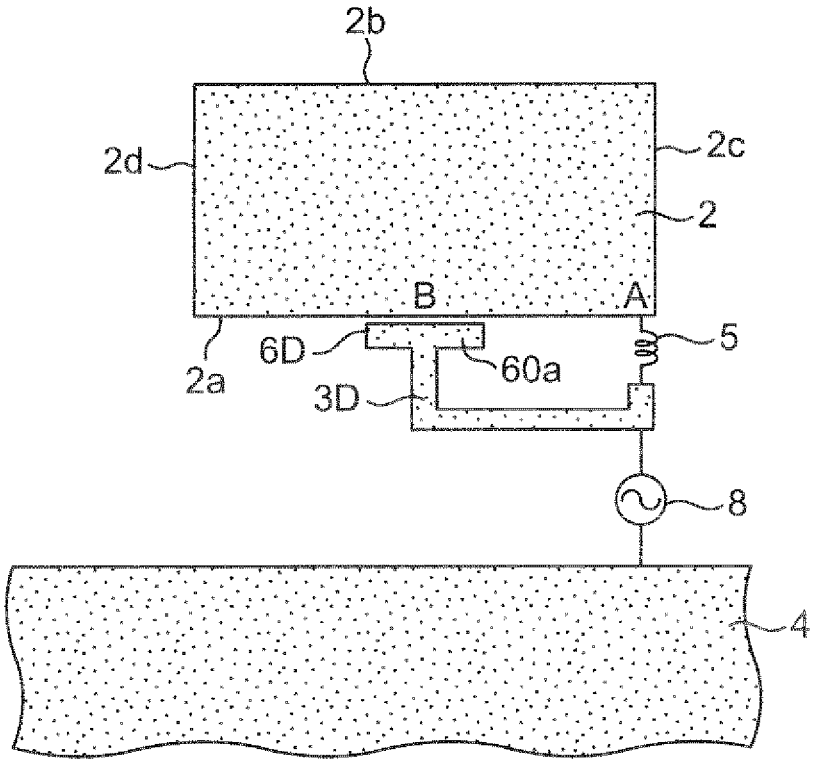
FIG. 11 is a diagram schematically illustrating the configuration of a dual-band antenna device of embodiment 4 according to the present disclosure.

FIG. 11 is a diagram schematically illustrating the configuration of the dual-band antenna device of embodiment 4. As illustrated in FIG. 11, in the configuration of the dual-band antenna device of embodiment 4, similarly to as in the configuration of embodiment 1, conductor electrode patterns consisting of the rectangular radiation electrode 2, a feeding electrode 3D, and the ground electrode 4 that is grounded are formed on the same plane.

In the configuration of embodiment 4, as illustrated in FIG. 11, a second adjusting element 6D, which is a capacitor element, is formed of a conductor pattern, and an electrode 60*a* is formed so as to be integrated with one end of the feeding electrode 3D. The other electrode of the second adjusting element 6D, which is a capacitor element, is a center region of the long side 2*a* of the radiation electrode 2 arranged so as to face the one electrode 60*a* with a predetermined distance therebetween. In other words, the second adjusting element 6D is formed of an electrode pattern arranged so as to face the center portion (high-frequency feeding point B) of the long side 2*a* of the radiation electrode 2 with a predetermined spacing (inter-electrode distance) therebetween. The other end of the feeding electrode 3D is electrically connected to the low-frequency feeding point A of the radiation electrode 2 via the first adjusting element 5, which is an inductor element. Similarly to as in the configuration of embodiment 1, the position of the low-frequency feeding point A of the radiation electrode 2 is at an end portion of the long side 2*a* of the radiation electrode 2 that extends in the longitudinal direction.

In the configuration of the dual-band antenna device of embodiment 4, the current flows that occur when excitation is performed using signals of a low-frequency band and a high-frequency band are the same as in the configuration of embodiment 1, and the current flows toward the short side 2*d* (open end side) of the radiation electrode 2 in the case of a low-frequency band and flows toward the long side 2*b* (open end side) of the radiation electrode 2 in the case of a high-frequency band.

In the thus-configured dual-band antenna device of the embodiment 4, the antenna efficiency can be optimized at the respective resonant frequencies in both a low-frequency band and a high-frequency band without the antenna efficiency in the low-frequency band and the antenna efficiency in the high-frequency band affecting each other by using the radiation electrode 2 having a single configuration and the feeding electrode 3D. In addition, in the configuration of embodiment 4, since a part of an adjusting element is formed of a conductor pattern, the process of mounting the adjusting element can be simplified, manufacturing is simplified, and the manufacturing cost can be reduced. Therefore, the dual-band antenna device of embodiment 4 can realize a dual-band antenna device that has excellent antenna performance and is low in cost.

Furthermore, in the configuration of the dual-band antenna device of embodiment 4, since the second adjusting element 6D, which is a capacitor element, is formed of a conductor pattern that is integrated with the feeding electrode 3D, it is possible to reduce manufacturing loss and improve manufacturing efficiency, and a device having stable quality and high antenna performance can be realized.

Embodiment 5

Hereafter, the configuration of a dual-band antenna device according to embodiment 5 of the present disclosure will be described while focusing on the points that are different from the configurations of embodiments 1 to 4. In the description of embodiment 5, elements having the same operations, configurations, and functions as those of embodiment 1 described above are denoted by the same reference symbols, and description thereof may be omitted in order to avoid redundant description.

The dual-band antenna device of embodiment 5 differs from the dual-band antenna device of embodiment 1 in that a second adjusting element (6E), which is a capacitor element, is formed of conductor patterns similarly to as in the configuration of embodiment 4 described above.

Figure 12:
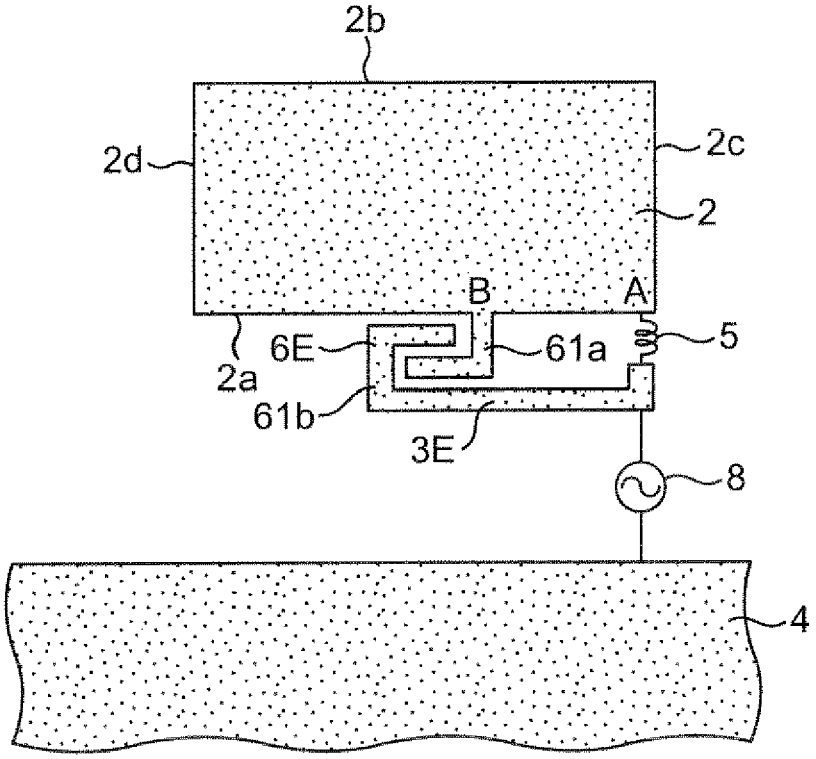
FIG. 12 is a diagram schematically illustrating the configuration of a dual-band antenna device of embodiment 5 according to the present disclosure.

FIG. 12 is a diagram schematically illustrating the configuration of the dual-band antenna device of embodiment 5. As illustrated in FIG. 12, in the configuration of the dual-band antenna device of embodiment 5, similarly to as in the configuration of embodiment 4 illustrated in FIG. 11, the second adjusting element 6E, which is a capacitor element, is formed of conductor patterns and is formed between a feeding electrode 3E and the radiation electrode 2. That is, the second adjusting element 6E, which is a capacitor element, is formed of a bent first electrode 61*a*, which extends from the center portion (high-frequency feeding point B) of the long side 2*a* of the radiation electrode 2, and a second electrode 61*b* that has a bent shape so as to face the bent first electrode 61*a* and is formed so as to integrated with one end of the feeding electrode 3E. The first electrode 61*a* and the second electrode 61*b* are arranged with a predetermined spacing therebetween and so as to have a predetermined facing region, therefore a desired capacitance is secured for the feeding electrode 3E.

In the configuration of embodiment 5, the other end of the feeding electrode 3E is electrically connected to the low-frequency feeding point A of the radiation electrode 2 via the first adjusting element 5, which is an inductor element. Similarly to as in the configuration of embodiment 1, the position of the low-frequency feeding point A of the radiation electrode 2 is at an end portion of the long side 2*a* of the radiation electrode 2 that extends in the longitudinal direction and is at a position close to the ground electrode 4. In addition, the power source 8 is electrically connected to the feeding electrode 3E. In the feeding electrode 3E, the signals of the low-frequency band and the high-frequency band from the power source 8 are branched and fed to the low-frequency feeding point A and the high-frequency feeding point B of the radiation electrode 2.

In the configuration of the dual-band antenna device of embodiment 5, the current flows that occur when excitation is performed using signals of a low-frequency band and a high-frequency band are the same in the configuration of embodiment 1, and the current flows toward the short side 2*d* (open end side) of the radiation electrode 2 in the case of a low-frequency band and flows toward the long side 2*b* (open end side) of the radiation electrode 2 in the case of a high-frequency band.

In the thus-configured dual-band antenna device of embodiment 5, the antenna efficiency can be optimized at the respective resonant frequencies in both a low-frequency band and a high-frequency band without the antenna efficiency in the low-frequency band and the antenna efficiency in the high-frequency band affecting each other by using the radiation electrode 2 having a single configuration and the feeding electrode 3E. In addition, in embodiment 5, since the second adjusting element (6E) is formed of conductor patterns, the process of mounting the adjusting element can be simplified, the manufacturing cost can be reduced, and manufacturing efficiency can be improved. Furthermore, the dual-band antenna device of embodiment 5 is a device having stable quality and high antenna performance.

Embodiment 6

Hereafter, the configuration of a dual-band antenna device according to embodiment 6 of the present disclosure will be described while focusing on the points that are different from the configurations of embodiments 1 to 5. In the description of embodiment 6, elements having the same operations, configurations, and functions as those of embodiment 1 described above are denoted by the same reference symbols, and description thereof may be omitted in order to avoid redundant description.

The dual-band antenna device of embodiment 6 differs from the dual-band antenna device of embodiment 1 in that a second adjusting element (6F), which is a capacitor element, is formed of conductor patterns similarly to as in the configurations of embodiment 4 and embodiment 5 described above.

Figure 13:
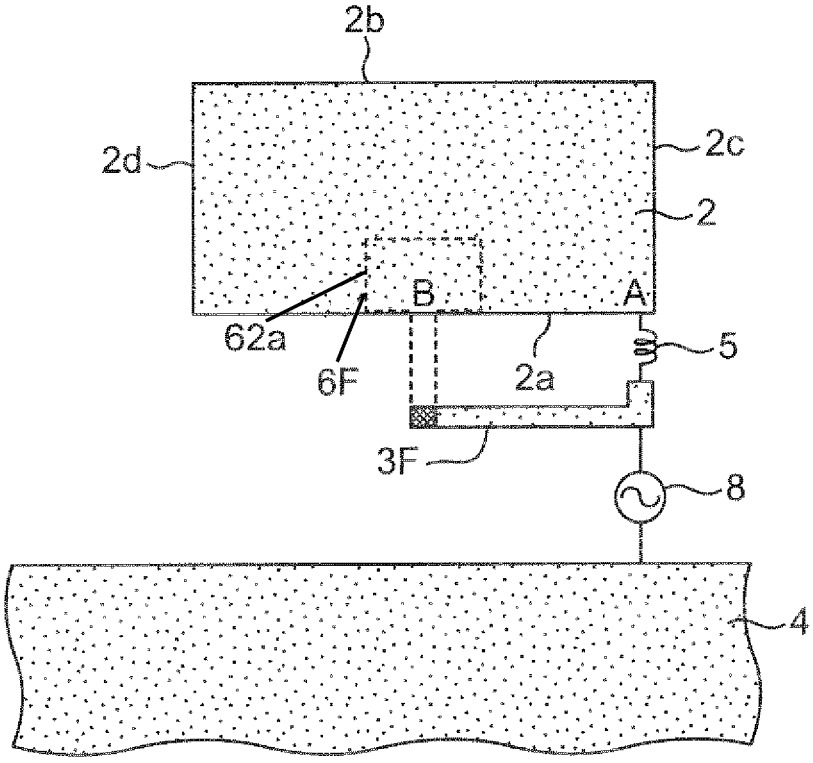
FIG. 13 is a diagram schematically illustrating the configuration of a dual-band antenna device of embodiment 6 according to the present disclosure.

FIG. 13 is a diagram schematically illustrating the configuration of the dual-band antenna device of embodiment 6. As illustrated in FIG. 13, in the configuration of the dual-band antenna device of embodiment 6, the second adjusting element 6F, which is a capacitor element, is formed of conductor patterns. The second adjusting element 6F in embodiment 6 is configured such that an end portion of the feeding electrode 3F that is on the radiation electrode 2 side forms one electrode 62*a* that is formed in a flat plate shape and the electrode 62*a* is arranged so as to sandwich a dielectric (the base 1) between the electrode 62*a* and the rear surface of the radiation electrode 2. In other words, the electrode pattern of the feeding electrode 3F is disposed on the rear surface side of the base body 1 (see FIG. 1), which is formed of a dielectric material, and the electrode 62*a*, which is formed in a flat plate shape, is provided at an end portion of the feeding electrode 3F. Therefore, one flat plate electrode of the second adjusting element 6F, which is a capacitor element, is the electrode 62*a* that is formed in a flat plate shape on the rear surface side, and the other flat plate electrode of the second adjusting element 6F consists of a center portion region of the long side 2*a* of the radiation electrode 2. In the configuration of the dual-band antenna device of embodiment 6, the second adjusting element 6F is formed of electrodes (2*a* and 62*a*) that are arranged so as to face each other with a dielectric sandwiched therebetween.

In the dual-band antenna device of embodiment 6, the capacitance of a capacitor element can be easily set to a desired value by forming the second adjusting element 6F as described above. Furthermore, in the configuration of embodiment 6, the power source 8 is electrically connected to the feeding electrode 3F. In the feeding electrode 3F, the signals of the low-frequency band and the high-frequency band from the power source 8 are branched and fed to the low-frequency feeding point A and the high-frequency feeding point B of the radiation electrode 2.

In the thus-configured dual-band antenna device of embodiment 6, the antenna efficiency can be optimized at the respective resonant frequencies in both the low-frequency band and the high-frequency band without the antenna efficiency in the low-frequency band and the antenna efficiency in the high-frequency band affecting each other by using the radiation electrode 2 having a single configuration and the feeding electrode 3F. In addition, in the configuration of embodiment 6, since the second adjusting element (6F) is formed of conductor patterns having simple configurations, the process of mounting the adjusting element can be simplified, manufacturing is simplified, and the manufacturing cost can be reduced. Furthermore, the dual-band antenna device of embodiment 6 is a device having stable quality and high antenna performance.

Embodiment 7

Hereafter, the configuration of a dual-band antenna device according to embodiment 7 of the present disclosure will be described while focusing on the points that are different from the configurations of embodiments 1 to 6. In the description of embodiment 7, elements having the same operations, configurations, and functions as those of embodiment 1 described above are denoted by the same reference symbols, and description thereof may be omitted in order to avoid redundant description.

The dual-band antenna device of embodiment 7 differs from the dual-band antenna device of embodiment 1 in that a part of an adjusting element is formed of a conductor pattern.

Figure 14:
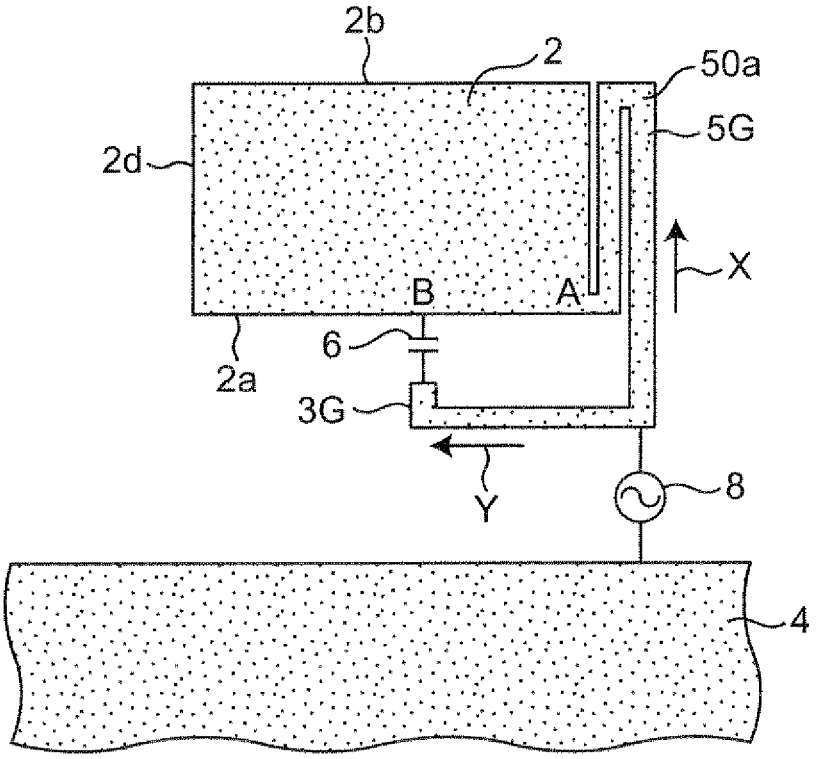
FIG. 14 is a diagram schematically illustrating the configuration of a dual-band antenna device of embodiment 7 according to the present disclosure.

FIG. 14 is a diagram schematically illustrating the configuration of the dual-band antenna device of embodiment 7. As illustrated in FIG. 14, in the configuration of the dual-band antenna device of embodiment 7, similarly to as in the configuration of embodiment 1, conductor electrode patterns consisting of the rectangular radiation electrode 2, a feeding electrode 3G, and the ground electrode 4 that is grounded are formed on the same plane.

In the configuration of embodiment 7, as illustrated in FIG. 14, a first adjusting element 5G, which is an inductor element, is formed of a conductor pattern (50*a*), and the first adjusting element 5G (50*a*) is integrated with the radiation electrode 2 and the feeding electrode 3G. The first adjusting element 5G, which is an inductor element, is formed at a short side (right short side in FIG. 14) of the radiation electrode 2. The first adjusting element 5G has a meandering shape in which the current path winds back and forth in the lateral direction and secures a desired inductance.

In the configuration of embodiment 7, one end of the meandering shaped first adjusting element 5G (50*a*) is connected to a corner part (end portion) region of the radiation electrode 2 between the long side 2*a* of the radiation electrode 2 that extends in the longitudinal direction and a short side of the radiation electrode 2. On the other hand, the other end of the first adjusting element 5G (50*a*) is connected to the feeding electrode 3G. The power source 8 is connected to a center part of the feeding electrode 3G. Therefore, the feeding electrode 3G forms a low-frequency feeding path X that is connected from the power source 8 to an end portion of the long side 2*a* of the radiation electrode 2 via the first adjusting element 5G and forms a high-frequency feeding path Y that is connected from the power source 8 to a center portion (high-frequency feeding point B) of the long side 2*a* of the radiation electrode 2 via the second adjusting element 6.

In the thus-configured dual-band antenna device of embodiment 7, the antenna efficiency can be optimized at the respective resonant frequencies in both a low-frequency band and a high-frequency band without the antenna efficiency in the low-frequency band and the antenna efficiency in the high-frequency band affecting each other by using the radiation electrode 2 having a single configuration and the feeding electrode 3G. In addition, in the configuration of embodiment 7, since the first adjusting element 5G is formed of a conductor pattern, the process of mounting the adjusting element can be simplified, manufacturing is simplified, and the manufacturing cost can be reduced. Therefore, the dual-band antenna device of embodiment 7 can realize a dual-band antenna device that has excellent antenna performance and is low in cost.

In addition, in the configuration of the dual-band antenna device of embodiment 7, since the first adjusting element 5G (50*a*), which is an inductor element, is formed of a conductor pattern, the manufacturing process can be simplified, the manufacturing cost can be reduced, and the manufacturing efficiency can be improved. Furthermore, the dual-band antenna device of embodiment 7 is a device having stable quality and high antenna performance.

Embodiment 8

Hereafter, the configuration of a dual-band antenna device according to embodiment 8 of the present disclosure will be described while focusing on the points that are different from the configuration of embodiment 7. In the description of embodiment 8, elements having the same operations and functions as in the configurations of embodiments 1 to 7 described above are denoted by the same reference symbols, and description thereof may be omitted in order to avoid redundant description.

The dual-band antenna device of embodiment 8 is identical to the dual-band antenna device of embodiment 7 except for the pattern shape of the conductor of a first adjusting element 5H.

Figure 15:
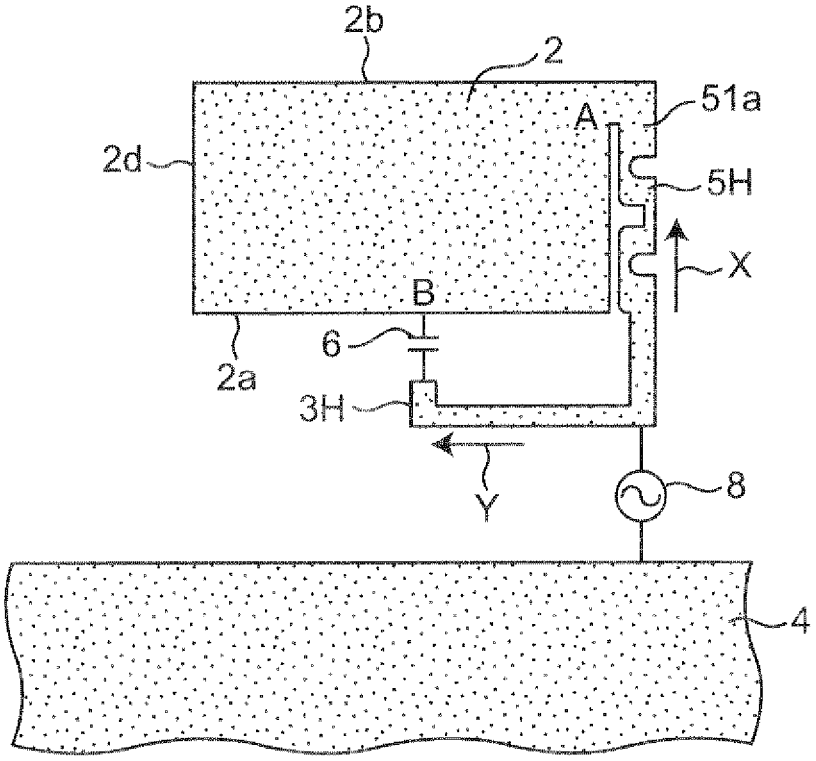
FIG. 15 is a diagram schematically illustrating the configuration of a dual-band antenna device of embodiment 8 according to the present disclosure.

FIG. 15 is a diagram schematically illustrating the configuration of the dual-band antenna device of embodiment 8. As illustrated in FIG. 15, in the configuration of the dual-band antenna device of embodiment 8, the first adjusting element 5H, which is an inductor element, is formed of a conductor pattern (51*a*) and is integrated with the radiation electrode 2 and a feeding electrode 3H. The first adjusting element 5H (51*a*), which is an inductor element, is formed at a short side (right short side in FIG. 15) of the radiation electrode 2. The first adjusting element 5H is formed in a meandering shape in which the current path winds back and forth in the longitudinal direction and secures a desired inductance.

In the configuration of embodiment 8, one end of the meandering shaped first adjusting element 5H (51*a*) is connected to a short side region of the radiation electrode 2. On the other hand, the other end of the first adjusting element 5H (51*a*) is connected to the feeding electrode 3H. The power source 8 is connected to a center part of the feeding electrode 3H. Therefore, the feeding electrode 3H forms a low-frequency feeding path X that is connected from the power source 8 to a short-side region of the radiation electrode 2 via the first adjusting element 5H and forms a high-frequency feeding path Y that is connected from the power source 8 to a center portion (high-frequency feeding point B) of the long side 2*a* of the radiation electrode 2 via the second adjusting element 6.

In the thus-configured dual-band antenna device of embodiment 8, the antenna efficiency can be optimized at the respective resonant frequencies in both a low-frequency band and a high-frequency band without the antenna efficiency in the low-frequency band and the antenna efficiency in the high-frequency band affecting each other by using the radiation electrode 2 having a single configuration and the feeding electrode 3H.

In addition, in the configuration of the dual-band antenna device of embodiment 8, since the first adjusting element 5H (51*a*), which is an inductor element, is formed of a conductor pattern, the manufacturing process can be simplified, the manufacturing cost can be reduced, and the manufacturing efficiency can be improved. Furthermore, the dual-band antenna device of embodiment 8 is a device having stable quality and high antenna performance. Therefore, the dual-band antenna device of embodiment 8 can realize a dual-band antenna device that has excellent antenna performance and is low in cost.

Embodiment 9

Hereafter, the configuration of a dual-band antenna device according to embodiment 9 of the present disclosure will be described while focusing on the points that are different from the configuration of embodiment 1. In the description of embodiment 9, elements having the same operations and functions as in the configurations of embodiments 1 to 7 described above are denoted by the same reference symbols, and description thereof may be omitted in order to avoid redundant description.

The dual-band antenna device of embodiment 9 differs from the dual-band antenna device of embodiment 1 with respect to the electrode patterns of the radiation electrode and the feeding electrode and the configurations of the adjusting elements.

Figure 16:
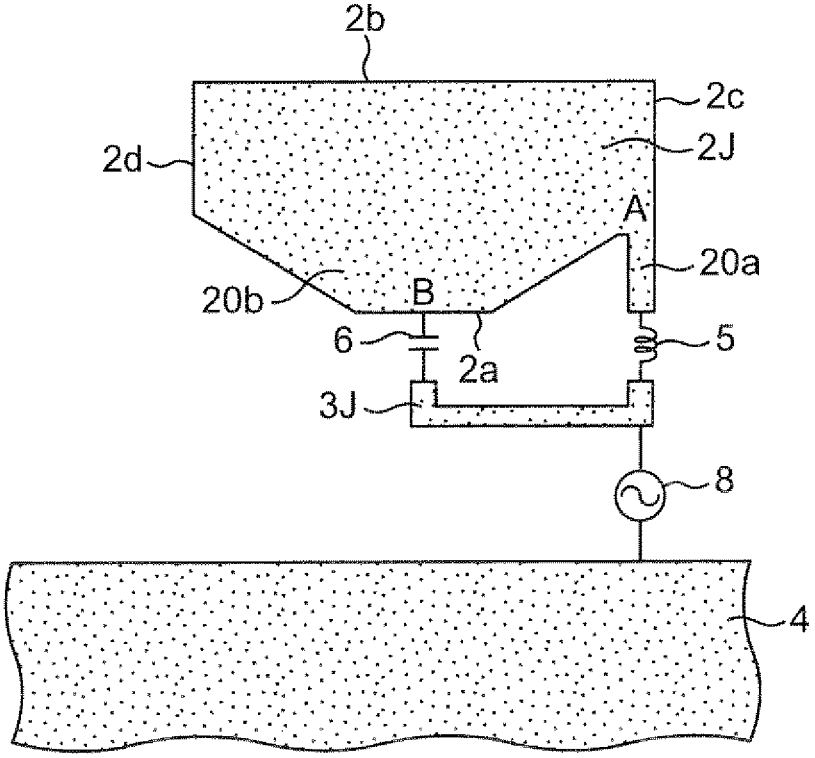
FIG. 16 is a diagram schematically illustrating the configuration of a dual-band antenna device of embodiment 9 according to the present disclosure.

FIG. 16 is a diagram schematically illustrating the configuration of the dual-band antenna device of embodiment 9. As illustrated in FIG. 16, in the configuration of the dual-band antenna device of embodiment 9, the configuration of a radiation electrode 2J is different. The shape of the radiation electrode 2J is a shape obtained by obliquely cutting off parts on both sides of a center part of the long side 2*a* of a rectangular shape while leaving the center part of the long side 2*a* that faces the ground electrode 4. In other words, a center region 20*b* of the radiation electrode 2J that faces the ground electrode 4 has a convex shape in which the center portion projects and both sides of the center portion are formed of gentle slopes. The center region 20*b* (protruding part) of the radiation electrode 2J is electrically connected to a feeding electrode 3J via the second adjusting element 6, which is a capacitor element.

The long side 2*b* of the radiation electrode 2J that is on the opposite side from the ground electrode 4 is formed with the long side of the rectangular shape remaining unaltered and extends linearly along the longitudinal direction of the radiation electrode 2J. Therefore, in the radiation electrode 2J in embodiment 9, the region on the ground electrode 4 side has a substantially trapezoidal shape and the remaining region has a rectangular shape, and the radiation electrode 2J has a shape that is a combination of these shapes.

In addition, a lead out portion 20*a* that is linearly extends toward the ground electrode 4 is formed at an end portion (right end portion in FIG. 16) of the radiation electrode 2J in the longitudinal direction. A led out end portion of the lead out portion 20*a* is electrically connected to the feeding electrode 3J via the first adjusting element 5. In the configuration of embodiment 9, the led out end of the lead out portion 20*a* of the radiation electrode 2J serves as the low-frequency feeding point A.

In the configuration of embodiment 9, the feeding electrode 3J electrically connects, to the power source 8 via the first adjusting element 5, the lead out portion 20*a* (low-frequency feeding point) that extends from a short side region of the radiation electrode 2. On the other hand, the feeding electrode 3J electrically connects the high-frequency feeding point B of the center region 20*b* of the radiation electrode 2J to the power source 8 via the second adjusting element 6.

In the configuration of embodiment 9, when excitation is performed using a low-frequency (for example, 2.4 GHz band), the current flows from the lead out portion 20*a* (low-frequency feeding point A) of the radiation electrode 2J toward another short side (2*d*) region, and the other short side 2*d* acts as an open end. On the other hand, when excitation is performed using a high-frequency (for example, 5 GHz band) signal, the current flows from the center region 20*b* (high-frequency feeding point B) of the radiation electrode 2J toward another long side (2*b*) region, and the other long side 2*b* acts as an open end. In the configuration of embodiment 9, the convex-shaped center region 20*b* having gentle slopes on both sides of the high-frequency feeding point B is provided and therefore the current in the radiation electrode 2J flows in a well-balanced manner through the center region 20*b* and antenna efficiency can be improved.

Furthermore, in the configuration of embodiment 9, the shape of the radiation electrode 2J is not specified as a rectangular shape, and a dual-band antenna device of the present disclosure can be configured in accordance with the shape of the base 1, which is a substrate, and a reduction in device size can be achieved.

In the thus-configured dual-band antenna device of embodiment 9, the antenna efficiency can be optimized at the respective resonant frequencies in both the low-frequency band and the high-frequency band without the antenna efficiency in the low-frequency band and the antenna efficiency in the high-frequency band affecting each other by using the radiation electrode 2 having a single configuration and the feeding electrode 3J. In addition, in the configuration of embodiment 9, antenna performance can be increased by providing the radiation electrode 2J with a particular shape. Therefore, the dual-band antenna device of embodiment 9 can realize a dual-band antenna device that has excellent antenna performance and is low in cost.

Embodiment 10

Hereafter, the configuration of a dual-band antenna device according to embodiment 10 of the present disclosure will be described while focusing on points that are different from the dual-band antenna devices of embodiments 1 to 9. In the description of embodiment 10, elements having the same operations, configurations, and functions as those of embodiment 1 described above are denoted by the same reference symbols, and description thereof may be omitted in order to avoid redundant description.

The dual-band antenna device of embodiment 10 differs from the dual-band antenna device of embodiment 1 with respect to a feeding electrode and a first adjusting element and a second adjusting element that are connected to the feeding electrode.

Figure 17:
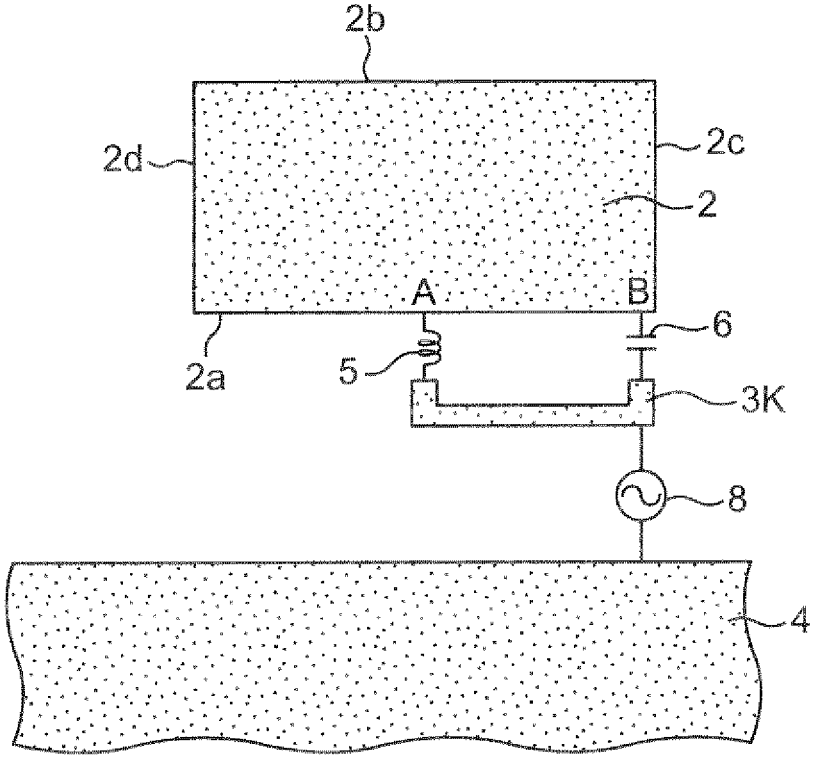
FIG. 17 is a diagram schematically illustrating the configuration of a dual-band antenna device of embodiment 10 according to the present disclosure.
Figure 18:
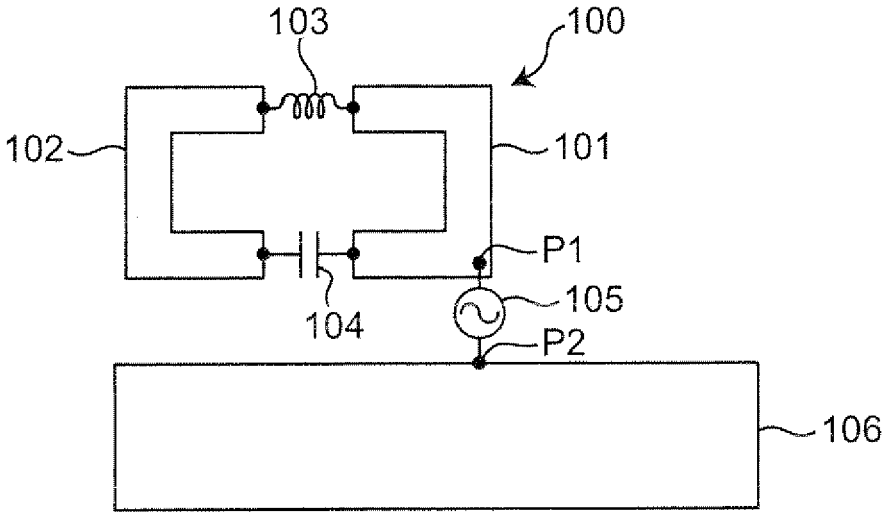
FIG. 18 is a diagram illustrating the configuration of an antenna device of the related art.

FIG. 17 is a diagram schematically illustrating the configuration of the dual-band antenna device of embodiment 10. As illustrated in FIG. 17, in the configuration of the dual-band antenna device of embodiment 10, the first adjusting element 5 is electrically connected to the center portion of the long side 2*a* of the radiation electrode 2 that extends in the longitudinal direction. In addition, the second adjusting element 6 is electrically connected to an end portion of the long side 2*a* of the radiation electrode 2 that extends in the longitudinal direction. In other words, in the configuration of the dual-band antenna device of embodiment 10, the low-frequency feeding point A is formed at the center portion of the long side 2*a* of the radiation electrode 2, and the high-frequency feeding point B is formed at an end portion of the long side 2*a* of the radiation electrode 2.

The thus-configured dual-band antenna device of embodiment 10 exhibits favorable antenna characteristics especially at the frequencies in the low-frequency band. Therefore, in particular, in the case where the antenna characteristics in a low-frequency band are to be improved, this can be achieved by adopting the configuration described in embodiment 10.

The configuration of embodiment 10 is a configuration for improving the antenna characteristics especially in the low-frequency band by swapping the positions of electrical connections to the radiation electrode 2 between the first adjusting element 5 and the second adjusting element 6, and this configuration can also be applied to the configurations of the above-described first to ninth embodiments by similarly swapping the positions.

As described above, in a dual-band antenna device of the present disclosure, the antenna efficiency can be optimized at the resonant frequencies in both a low-frequency band and a high-frequency band without the antenna efficiency in the low-frequency band and the antenna efficiency in the high-frequency band affecting each other by changing the feeding points for the low-frequency band and the high-frequency band by using a radiation electrode having a single configuration and a feeding electrode that substantially branches. Therefore, the dual-band antenna device of the present disclosure has excellent antenna performance and can realize band widening.

Although the present disclosure has been described in a certain degree of detail in each embodiment, these configurations are exemplary, and the disclosed contents of these embodiments should be changed in the particulars of the configurations. In the present disclosure, the elements in each embodiment can be replaced, combined, and changed in terms of order without departing from the scope and spirit of the claimed disclosures.

The present disclosure can provide a dual-band antenna device having excellent antenna characteristics, and therefore can be used as the antenna of various products in wireless communication devices and has high versatility.

1 base
2 radiation electrode
3 feeding electrode
3*a* first branch feeding electrode
3*b* second branch feeding electrode
3*c* common feeding electrode
4 ground electrode
5 first adjusting element (inductor element)
6 second adjusting element (capacitor element)
7 third adjusting element (capacitor element)
8 power source
A connection point (low-frequency feeding point)
B connection point (high-frequency feeding point)
C branching point
X first current path (low-frequency feeding path)
Y second current path (high-frequency feeding path)

The invention claimed is:

1. A dual-band antenna device comprising: a power source outputting low-frequency and high-frequency signals; a feeding electrode, wherein the low-frequency and high-frequency signals are supplied from the power source to the feeding electrode, and the feeding electrode branches into a first branch feeding electrode and a second branch feeding electrode, wherein the first branch feeding electrode mainly serves as a low-frequency signal path, and the second branch feeding electrode mainly serves as a high-frequency signal path;

a radiation electrode having a rectangular shape in a longitudinal direction, and having a low-frequency feeding point and a high-frequency feeding point, wherein the first branch feeding electrode is electrically connected to the low-frequency feeding point, and the second branch feeding electrode is electrically connected to the high-frequency feeding point;

an inductor element provided in the feeding electrode and forming the low-frequency signal path in the feeding electrode; and a capacitor element provided in the feeding electrode and forming the high-frequency signal path in the feeding electrode, wherein in the radiation electrode;

the low-frequency feeding point is provided close to an end portion of the rectangular shape in the longitudinal direction and the high-frequency feeding point is provided at a center portion of a side of the rectangular shape extending in the longitudinal direction, or the high-frequency feeding point is provided close to an end portion of the rectangular shape in the longitudinal direction and the low-frequency feeding point is provided at a center portion of a side of the rectangular shape extending in the longitudinal direction wherein when the low-frequency signal is supplied from the power source, current of the radiation electrode flows in the longitudinal direction from the low-frequency feeding point provided close to the end portion of the radiation electrode, and wherein when the high-frequency signal is supplied from the power source, current of the radiation electrode flows in a lateral direction from the high-frequency feeding point provided at the center portion of the radiation electrode.

2. The dual-band antenna device according to claim 1, wherein in the radiation electrode, the low-frequency feeding point is provided close to an end portion of a side of the rectangular shape extending in the longitudinal direction and a low-frequency signal is supplied from the power source to the low-frequency feeding point, and the high-frequency feeding point is provided at a center portion of a side of the rectangular shape extending in the longitudinal direction and a high-frequency signal is supplied from the power source to the high-frequency feeding point.

3. The dual-band antenna device according to claim 2, wherein the inductor element is provided on a path extending from the power source to the low-frequency feeding point of the radiation electrode via the first branch feeding electrode.

4. The dual-band antenna device according to claim 2, wherein the capacitor element is provided on a path extending from the power source to the high-frequency feeding point of the radiation electrode via the second branch feeding electrode.

5. The dual-band antenna device according to claim 2, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

6. The dual-band antenna device according to claim 1, wherein in the radiation electrode, the low-frequency feeding point is provided on a side of the rectangular shape extending in a direction perpendicular to the longitudinal direction and a low-frequency signal is supplied from the power source to the low-frequency feeding point, and the high-frequency feeding point is provided at a center portion of a side of the rectangular shape extending in the longitudinal direction and a high-frequency signal is supplied from the power source to the high-frequency feeding point.

7. The dual-band antenna device according to claim 6, wherein the inductor element is provided on a path extending from the power source to the low-frequency feeding point of the radiation electrode via the first branch feeding electrode.

8. The dual-band antenna device according to claim 6, wherein the capacitor element is provided on a path extending from the power source to the high-frequency feeding point of the radiation electrode via the second branch feeding electrode.

9. The dual-band antenna device according to claim 6, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

10. The dual-band antenna device according to claim 1, wherein the inductor element is provided on a path extending from the power source to the low-frequency feeding point of the radiation electrode via the first branch feeding electrode.

11. The dual-band antenna device according to claim 10, wherein the capacitor element is provided on a path extending from the power source to the high-frequency feeding point of the radiation electrode via the second branch feeding electrode.

12. The dual-band antenna device according to claim 10, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

13. The dual-band antenna device according to claim 1, wherein the capacitor element is provided on a path extending from the power source to the high-frequency feeding point of the radiation electrode via the second branch feeding electrode.

14. The dual-band antenna device according to claim 13, wherein at least two capacitor elements are provided on the path extending from the power source to the high-frequency feeding point of the radiation electrode via the second branch feeding electrode.

15. The dual-band antenna device according to claim 14, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

16. The dual-band antenna device according to claim 13, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

17. The dual-band antenna device according to claim 1, further comprising: a ground electrode, wherein the power source is connected to the ground electrode; wherein the radiation electrode has a convex shape projecting toward the ground electrode, the high-frequency feeding point is arranged at a center portion of the convex shape and the second branch feeding electrode is electrically connected to the high-frequency feeding point, and when excitation is performed using a high-frequency signal, a long side of the rectangular shape extending in the longitudinal direction and facing the convex shape acts as an open end.

18. The dual-band antenna device according to claim 1, wherein the feeding electrode includes a common feeding electrode, low-frequency and high-frequency signals are supplied from the power source to the common feeding electrode, and the common feeding electrode branches into the first branch feeding electrode and the second branch feeding electrode, and the inductor element is electrically connected to the first branch feeding electrode, and the capacitor element is electrically connected to the second branch feeding electrode.

19. The dual-band antenna device according to claim 1, wherein the inductor element comprises a conductor pattern having an inductance.

20. The dual-band antenna device according to claim 1, wherein the capacitor element comprises a conductor pattern having a capacitance.

* * * * *